US006800868B2

(12) United States Patent
Kawamura et al.

(10) Patent No.: US 6,800,868 B2
(45) Date of Patent: Oct. 5, 2004

(54) DEVICE FOR DISCRIMINATING AMONG PRINT MEDIA

(75) Inventors: Yoshinori Kawamura, Kanagawa (JP); Takashi Koizumi, Kanagawa (JP); Tsukasa Ono, Kanagawa (JP); Kazuhisa Tazaki, Saitama (JP)

(73) Assignees: Fuji Photo Film Co., Ltd., Kanagawa (JP); Fuji Photo Optical Co., Ltd., Saitama (JP)

( * ) Notice: Subject to any disclaimer, the term of this patent is extended or adjusted under 35 U.S.C. 154(b) by 12 days.

(21) Appl. No.: 09/799,558

(22) Filed: Mar. 7, 2001

(65) Prior Publication Data

US 2001/0020688 A1 Sep. 13, 2001

(30) Foreign Application Priority Data

Mar. 7, 2000 (JP) ..... 2000-062666

(51) Int. Cl.[7] ..... G01N 21/86
(52) U.S. Cl. ..... 250/559.4; 347/105
(58) Field of Search ..... 250/559.39–559.46, 250/559.16; 356/239.1, 239.7, 429–431, 446; 399/389; 400/708; 347/14, 105, 106

(56) References Cited

U.S. PATENT DOCUMENTS

| | | | | |
|---|---|---|---|---|
| 5,139,339 A | * | 8/1992 | Courtney et al. | 250/559.16 |
| 5,177,543 A | * | 1/1993 | Rodenberg et al. | 399/224 |
| 5,774,146 A | * | 6/1998 | Mizutani | 347/12 |
| 6,085,657 A | * | 7/2000 | Rombult et al. | 101/471 |
| 6,217,168 B1 | * | 4/2001 | Elgee | 250/559.4 |
| 6,229,602 B1 | * | 5/2001 | Hirai et al. | 356/213 |
| 6,373,044 B1 | * | 4/2002 | Seehawer | 250/214 R |

* cited by examiner

*Primary Examiner*—Thanh X. Luu
(74) *Attorney, Agent, or Firm*—Sughrue Mion, PLLC

(57) ABSTRACT

A pair of optical sensors are disposed above photopolymer plates and interleaf papers, which are alternately stacked with one another. These optical sensors basically have the same structure. However, the optical sensor is disposed so as to be inclined to an optical axis of reflected light, and therefore, a detection level of the optical sensor substantially becomes low. Accordingly, although the optical sensors each react to the reflected light from the photopolymer plate, the optical sensor does not react to the reflected light from the interleaf paper. As a result, it is determined whether the uppermost layer of the stack is the photopolymer plate or the interleaf paper. In a discriminating device of the present invention, general purpose optical sensors adapted to react to light having such a fixed intensity or greater, are used.

23 Claims, 12 Drawing Sheets

DEVICE FOR DISCRIMINATING AMONG PRINT MEDIA

BACKGROUND OF THE INVENTION

1. Field of the Invention

The present invention relates to a discriminating device for discriminating between two kinds of objects of determination based on the reflected light thereof.

2. Description of the Related Art

A technique has been developed, wherein a printing plate (hereinafter referred to as a photopolymer plate) having a photosensitive layer (for example, a photopolymerization layer) provided on a support is used and an image is directly recorded on the photopolymerization layer of the photopolymer plate by a laser beam or the like (an automatic exposure apparatus for printing plates).

In such a technique, a plurality of photopolymer plates accommodated in a magazine are taken out one-by-one from the magazine and transferred to an exposure section in which the above-described recording of images is carried out. Further, immediately before the exposure section, the photopolymer plate is basically placed on a smooth surface table and registered on the surface table, and thereafter, the photopolymer plate is transferred to the exposure section together with the surface table.

The photopolymer plates are stacked in the above-described magazine, and interleaf papers are interposed between the photopolymer plates so that the photopolymer plates and the interleaf papers are alternately stacked with one another. If a photopolymer plate is located at the uppermost position of the stack, the photopolymer plate is transferred to the exposure section as described above. If an interleaf paper is disposed at the uppermost position of the stack, the interleaf paper needs to be discharged from a conveying path to the exposure section without being transferred to the exposure section.

Accordingly, a discriminating device structured to include a laser light source disposed above the stack of photopolymer plates and interleaf papers, and a laser reflection sensor which receives laser light reflected by a surface of photopolymer plate or interleaf paper, is used to discriminate between photopolymer plate and interleaf paper based on the intensity of reflected laser light.

However, the laser reflection sensor which receives laser light is adapted to generate a signal corresponding to the intensity of received laser light, and therefore, the structure thereof is complicated and expensive. As a result, when such a laser reflection sensor is used, the discriminating device, and further, an automatic exposure apparatus for printing plates may increase in costs.

SUMMARY OF THE INVENTION

In view of the above-described facts, an object of the present invention is to provide a discriminating device by which two kinds of objects of determination having different surface reflectivities can be discriminated at a low cost.

A first aspect of the present invention is a discriminating device for discriminating between two kinds of objects of determination, which have different surface reflectivities, comprising: a first optical sensor having a light receiving portion which receives light reflected by surfaces of the objects of determination, the first optical sensor reacting to either reflected light from the two kinds of objects of determination; and a second optical sensor having a light receiving portion which receives the reflected light, the second optical sensor being provided so as to react to reflected light from one of the objects of determination, of which surface reflectivity is higher, and so as not to react to reflected light from the other object of determination of which surface reflectivity is lower.

In the discriminating device having the above-described structure, both the first optical sensor and the second optical sensor receive the reflected light from the objects of determination. First, the first optical sensor is brought into a state of reacting to either reflected light from the two kinds of objects of determination. As a result, at least a state in which the two kinds of objects of determination are located at a predetermined position to be determined, is detected, and a discrimination between the two kinds of objects can be started. Next, if the second optical sensor is in a reactive state, it can be determined that an object to be determined is one of the two kinds of objects having a higher surface reflectivity. If the second optical sensor is in a nonreactive state, it can be determined that an object to be determined is the other one of the two kinds of objects having a lower surface reflectivity. Further, for example, if the first optical sensor is in a nonreactive state, it can be determined that none of the two kinds of objects is located at a position at which the reflected light can be received by the first and second optical sensors (there are cases in which others than the two kinds of objects may be located).

As described above, the discriminating device of the present invention is adapted to discriminate between the two kinds of objects based on the difference of light-receiving level between the two kinds of optical sensors. Therefore, low-cost and general purpose optical sensors suffice. As a result, the cost of apparatus itself can be reduced.

In the discriminating device according to the first aspect of the present invention, preferably, the light receiving portion of the first optical sensor is made to face an optical axis of the reflected light, and the light receiving portion of the second optical sensor is inclined to the optical axis of the reflected light.

In the discriminating device having the above-described structure, the light receiving portion of the first optical sensor is disposed so as to face the optical axis of the reflected light, but the light receiving portion of the second optical sensor is inclined to the optical axis of the reflected light. Therefore, even if the first optical sensor and the second optical sensor have the same light-receiving level, the reflected light is obliquely received by the second optical sensor, and the light-receiving level of the second optical sensor substantially becomes low. For this reason, optical sensors of the same standard can be used for the first optical sensor and the second optical sensor, thereby resulting in that the cost of the device can be further reduced.

In the above-described discriminating device, more preferably, the first optical sensor and the second optical sensor do not each react to reflected light from a portion in which the two kinds of objects of determination are placed.

In the above-described discriminating device, neither the first optical sensor nor the second optical sensor reacts to light reflected by a portion in which the objects of determination are placed. Therefore, a state in which neither of the two kinds of objects of determination is placed in the above-described portion, can be detected.

In any one of the above-described discriminating devices, still more preferably, a printing plate on which an image is recorded, is used as one of the two kinds of objects of determination, and an interleaf paper of which surface reflectivity is different from that of the printing plate and which is interposed between stacked printing plates, is used as the other one of the two kinds of objects of determination.

In the discriminating device having the above-described structure, one of the two kinds of objects of determination is a printing plate and the other is an interleaf paper interposed between a plurality of printing plates. In this aspect, normally, respective subsequent processing for the printing paper and interleaf paper is different from each other. When it is determined by the discriminating device whether an object to be determined is the printing paper or the interleaf paper based on the difference of surface reflectivity between the printing plate and the interleaf paper, the printing plate and the interleaf paper can be processed in a process corresponding to each of the printing plate and the interleaf paper.

BRIEF DESCRIPTION OF THE DRAWINGS

FIG. 9A shows a state in which a temporary supporting arm is placed at a horizontal position; FIG. 9B shows a state in which the temporary supporting arm is placed at a retracted position; and FIG. 9C shows a state in which the temporary supporting arm is pushed upward.

DESCRIPTION OF THE PREFERRED EMBODIMENTS

A description will be hereinafter given of an automatic exposure apparatus 100 for printing plates or photopolymer plates 102 each serving as one of objects of determination, to which a discriminating device 510 according to an embodiment of the present invention is applied. First, the structure of an entire apparatus will be schematically described, and subsequently, a principal part of the embodiment of the present invention will be described.

[Overall Structure of Automatic Exposure Apparatus 100]

Figure 1:
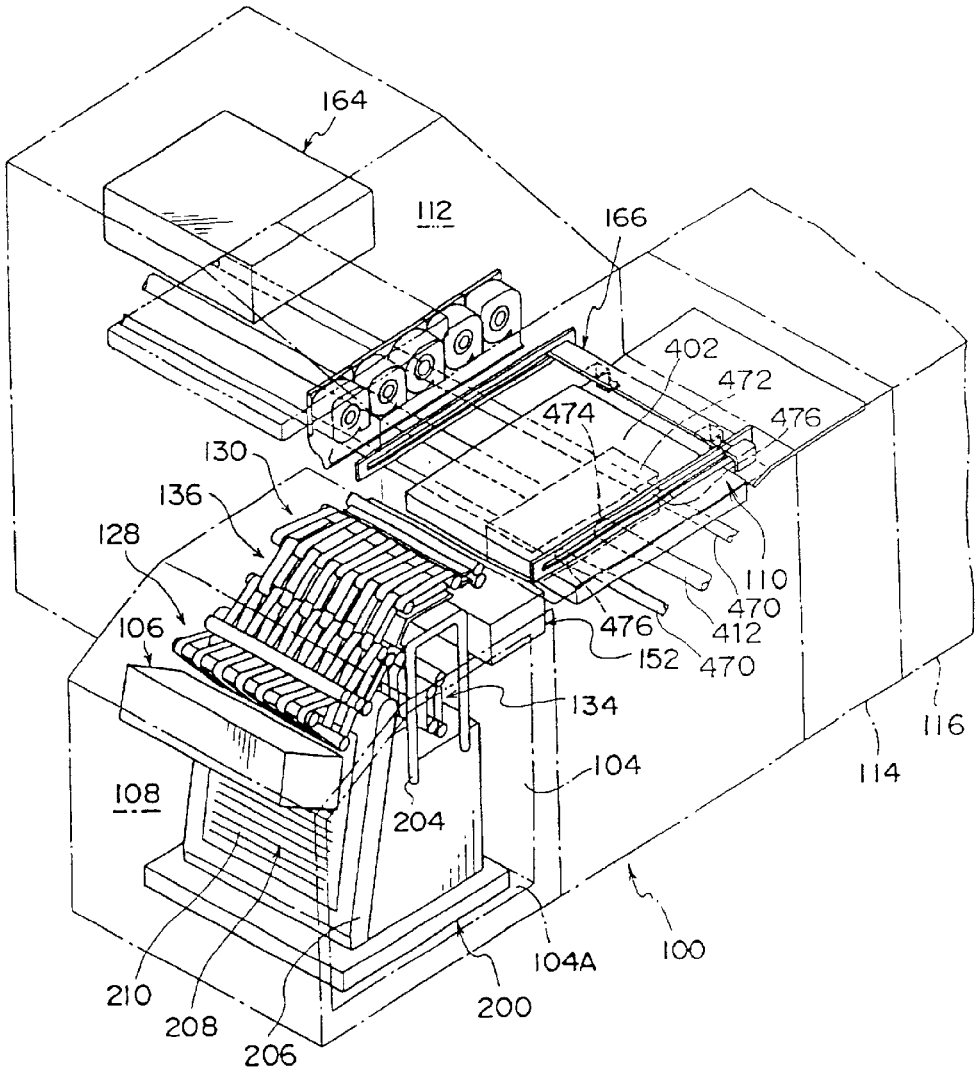
FIG. 1 is a perspective view which shows an overall structure of an automatic exposure apparatus to which an embodiment of the present invention is applied.

FIG. 1 is a perspective view which shows an overall structure of the automatic exposure apparatus 100 for photopolymer plates according to the embodiment of the present invention. As shown in this drawing, the automatic exposure apparatus 100 is mainly divided into the following four sections: a plate supplying section 108 which operate to supply photopolymer plates 102 (see FIG. 2); an exposure section 112 in which an image is recorded on the photopolymer plate 102; an exposure-conveying section 110, serving as a printing plate conveying device, for supplying the photopolymer plate 102 conveyed from the plate supplying section 108 to the exposure section 112; and a discharging mechanism section 166 for discharging the photopolymer plate 102 on which an image has been recorded by the exposure section 112. These sections will be described hereinafter in the order described above.

Plate Supplying Section 108:

An automatic processing apparatus 116 can be connected at a downstream side of the automatic exposure apparatus 100 via a buffer section 114, and supplying of plates, exposure, and processing can all be automatically processed.

Figure 3:
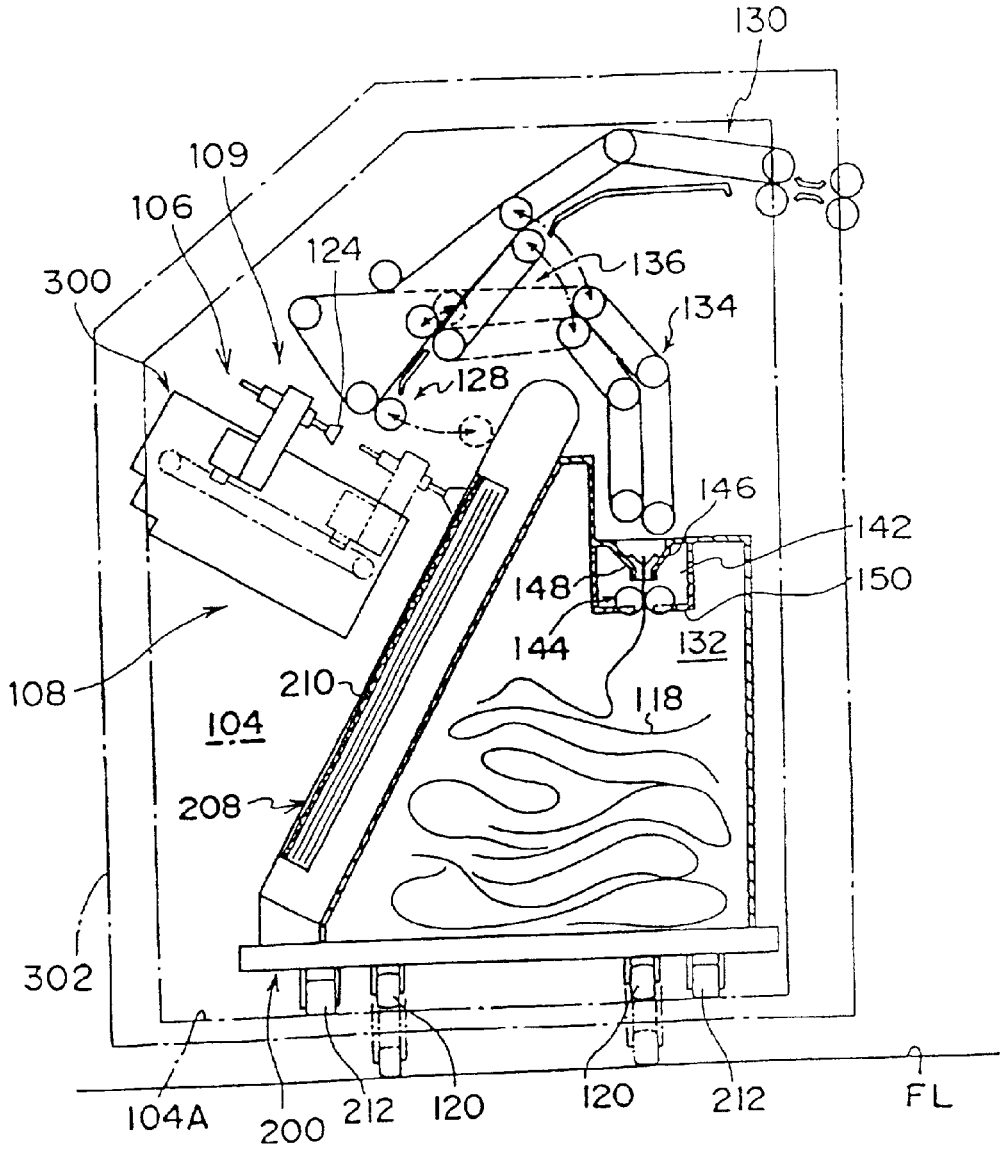
FIG. 3 is a side view of a plate supplying section.

As shown in FIGS. 1 and 3, the plate supplying section 108 which operates to supply the photopolymer plates 102, is schematically formed by the following portions: a plate accommodating portion 104 in which a carriage 200 with photopolymer plates 102 placed thereon is accommodated; a sheet feeding portion 106 for taking out the photopolymer plates 102 accommodated in the plate accommodating portion 104; a shared conveying portion 128 which receives and conveys the photopolymer plate 102 or an interleaf paper 118, serving as another object of determination, from the sheet feeding portion 106; a photopolymer plate conveying portion 130 which receives the photopolymer plate 102 from the shared conveying portion 128 and conveys the same to the exposure-conveying section 110; an interleaf paper conveying portion 134 which receives the interleaf paper 118 from the shared conveying portion 128 and conveys the same to an interleaf paper accommodating portion 132 (provided in the carriage 200); and a conveying switch portion 136 which effects a switching operation so as to convey the photopolymer plate 102 and the interleaf paper 118 from the shared conveying portion 128 to the photopolymer plate conveying portion 130 and the interleaf paper conveying portion 134 respectively.

Figure 2:
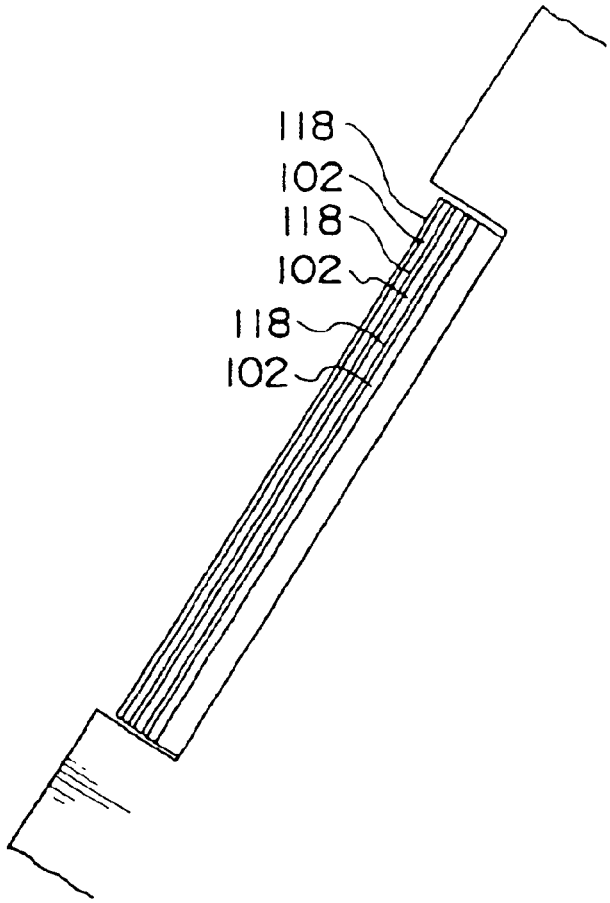
FIG. 2 is a side view which shows a state in which photopolymer plates and interleaf papers are stacked in a magazine.

Plate Accommodating Section 104:

As shown in FIG. 3, the carriage 200 in which a handle 204 is mounted is accommodated in the plate accommodating portion 104 of the plate supplying section 108. An accumulating portion 206 formed substantially into a right angled triangle when seen from the side surface of the apparatus is provided on a loading space 202 of the carriage 200. Further, a magazine 208 in which a plurality of photopolymer plates 102 can be accommodated in a stack, is placed against an inclined surface of the accumulating portion 206. As shown in FIG. 2, the interleaf paper 118 serving as a sheet material for protecting the surface of the photopolymer plate 102, is applied to the surface of each of the photopolymer plates. As a result, the photopolymer plates 102 and the interleaf papers 108 are alternately stacked with one another.

The magazine 208 is equipped with a shutter 210. Due to the shutter 210 being closed in other places than a dark room, the photopolymer plates 102 are prevented from being exposed to light. Practically, the carriage 200 is conveyed between the plate accommodating section 104 and a dark room in which the photopolymer plates 102 are stored, and therefore, exposure of the photopolymer plates 102 to light during the conveying operation is prevented by the shutter 210.

Although not illustrated, a pair of guide plates are provided in the magazine 208 so as to adjust both transverse direction ends of each of the accommodated photopolymer plates 102 and interleaf papers 118. Separation plates are provided at an end of each of the guide plates in such a manner as to correspond to two corners at the end of the accommodated photopolymer plates 102 and interleaf papers 118. The separation plates are members which, when the photopolymer plate 102 is taken out from the magazine 208 by a sucker unit 300, which will be described later in detail, functions so as to engage with the photopolymer plate 102 to bend the corners at the end of the photopolymer plate 102, thereby separating the photopolymer plate 102 from the interleaf paper 118 disposed directly below.

Further, a pair of interleaf paper pressing plates (not shown) are provided at an intermediate portion of the magazine 208 in the transverse direction thereof. The interleaf paper pressing plates are provided so as to correspond to the interleaf paper 118 on the surface of the photopolymer plate 102 accommodated in the magazine 208, and have a function of engaging with and holding the interleaf paper 118 when the photopolymer plate 102 is taken out from the magazine 208 by the sucker unit 300, which will be described in detail.

As shown in FIG. 3, the plate accommodating section 104 in which the carriage 200 having the magazine 208 is accommodated, includes a floor portion 104A at a position higher than the floor surface FL, and the carriage 200 is formed so as to ride on the floor portion 104A above the floor surface FL. That is, the carriage 200 is supported via casters 120 with respect to the floor surface FL and the casters 120 can be moved between a position at which it projects from the carriage 200 (that is, the position indicated by the phantom lines in FIG. 3) and a position at which it is accommodated in the carriage 200 (that is, the position indicated by solid lines in FIG. 3). When the casters 120 are moved to the accommodated position in such a manner as to be made retractable toward the upper side corresponding to an operation of accommodating the carriage 200 in the plate accommodating section 104, auxiliary rollers 212 simultaneously correspond to the floor portion 104A. Thereafter, the carriage 200 is supported by the floor portion 104A via the auxiliary rollers 212.

Figure 11:
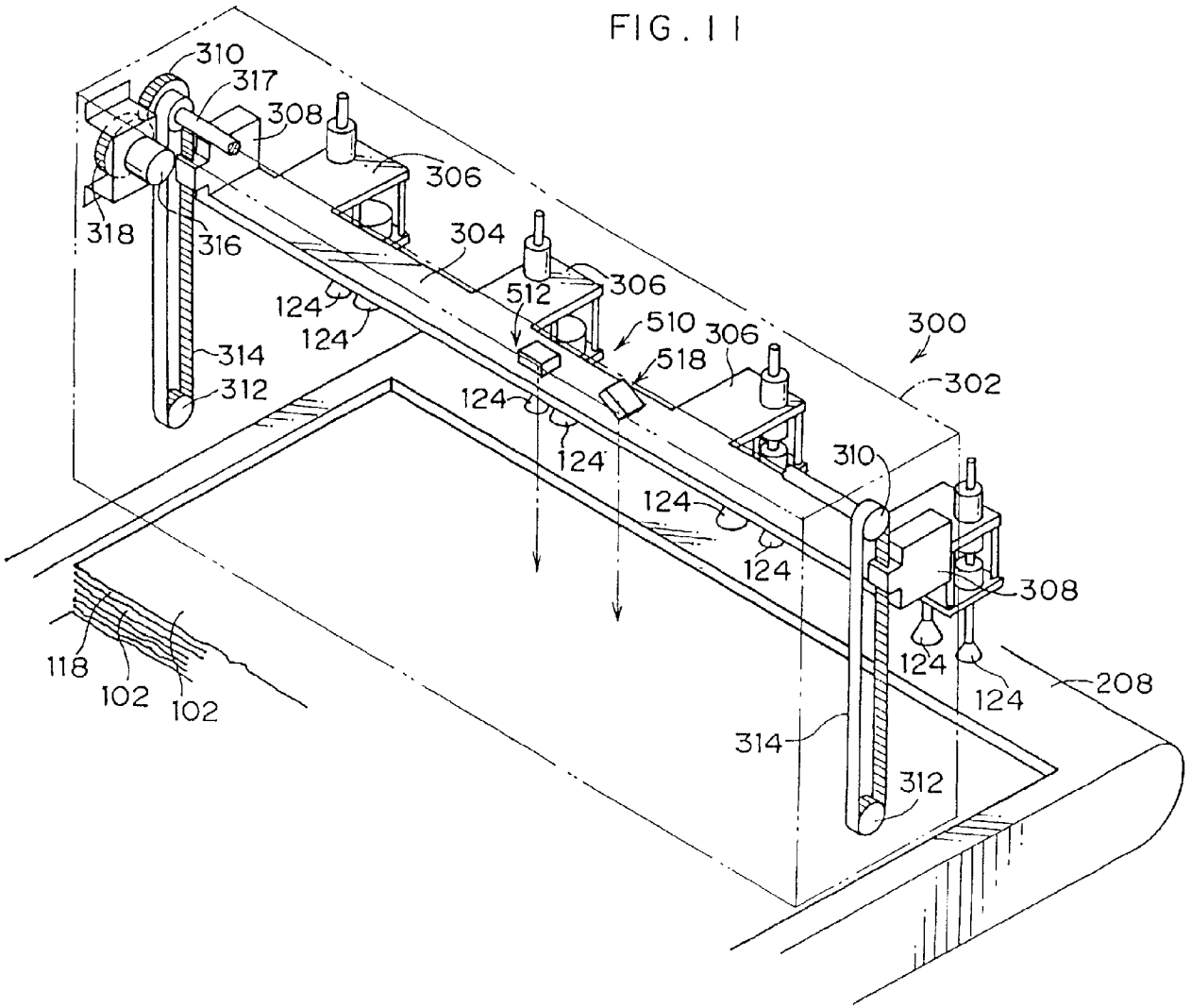
FIG. 11 is a perspective view which schematically shows a structure of a sucker unit.

Sheet Feeding Section 106:

The sheet feeding section 106 is provided above the above-described plate accommodating section 104. The sheet feeding section 106 includes the sucker unit 300. As shown in FIG. 11, the sucker unit 300 includes a housing 302 disposed so as to face the photopolymer plates 102 and the interleaf papers 118 stacked in the magazine 208. A movable frame 304 is accommodated in the housing 302. The movable frame 304 has a plate-shaped configuration of which longitudinal direction corresponds to the transverse direction of the photopolymer plates 102 and the interleaf papers 118 stacked in the magazine 208. A plurality of (for example, three in the present embodiment) sucker supporting portions 306 are formed at an intermediate portion in the longitudinal direction of the movable plate 304 at predetermined intervals along the movable plate 304, and the sucker supporting portions 306 each support a sucker 124 facing the photopolymer plates 102 and the interleaf papers 118. Further, brackets 308 are respectively provided at both longitudinal direction ends of the movable frame 304 and are formed integrally with the movable frame 304.

A gear 310 of which axial direction corresponds to the longitudinal direction of the movable frame 304 is provided on an inner wall of the housing 302 at one of the longitudinal direction ends of the movable frame 304. A gear 312 is disposed below the gear 310, namely, at the side close to the magazine 208. A toothed belt 314 is entrained around these gears 310 and 312.

Further, the gear 310 is engaged with an output gear 318 of a motor 316 provided within the housing 302. Therefore, the gear 310 is rotated due to rotating force of the motor 316 and the toothed belt 314 is thereby rotated.

The gears 310 and 312, and the toothed belt 314 are also provided on the inner wall of the housing 302 at the other longitudinal direction end of the movable frame 304, but a driving device such as the motor 316 is not provided at the other longitudinal direction end of the movable frame 304.

The brackets 308 of the movable frame 304 are respectively engaged with the above-described one pair of toothed belts 314. Due to one of the toothed belts 314 being rotated by rotating force of the motor 316, the movable frame 304 moves close to and apart from the photopolymer plates 102 and the interleaf papers 118. When the movable frame 304 moves close to the photopolymer plates 102 and the interleaf papers 118, the photopolymer plates 102 and the interleaf papers 118 are alternately taken out by being suction adhered to the suckers 124, and further conveyed to the shared conveying portion 128. Further, the sheet feeding section 106 includes a fan (not shown) in addition to the suckers 124. When the interleaf paper 118 is suction adhered to the suckers 124, the suction fan is disposed slightly apart from the interleaf paper 118 (or may be brought into contact with the interleaf paper 118), and only the interleaf paper 118 which is formed as a light weight and thin paper, is sucked to be lifted up by operating only the suction fan. Thereafter, the interleaf paper 118 is suction adhered to the suckers 124, thereby preventing double suction at the time of suction-adhering of the interleaf paper 118 (that is, a state in which the photopolymer plate 102 located directly below the interleaf paper 118 is suction adhered together with the interleaf paper 118).

Shared Conveying Portion 128, Photopolymer Plate Conveying Portion 130, and Conveying Switch Portion 136:

As shown in FIG. 1, the photopolymer plate 102 or the interleaf paper 118 conveyed from the sheet feeding section 106 is conveyed by the shared conveying portion 128. Thereafter, the conveying direction is selectively switched by the conveying switch portion 136. The photopolymer plate 102 is conveyed by the photopolymer plate conveying portion 130 to a surface table 402, and the interleaf paper 118 is conveyed by the interleaf paper conveying portion 134 to the interleaf paper accommodating portion 132 provided in the carriage 200. That is, the photopolymer plates 102 and the interleaf papers 118 are alternately stacked with one another, and therefore, the conveying switch portion 136 is switched over each time these plates and papers are each adhered by suction in the sheet feeding section 106, and the photopolymer plates 102 and the interleaf papers 118 are each adapted to be conveyed in a predetermined direction. There are many points at which structures are common to the shared conveying portion 128, the photopolymer plate conveying portion 130, and the conveying switch portion 136, and therefore, they will be collectively described hereinafter.

Figure 4A:
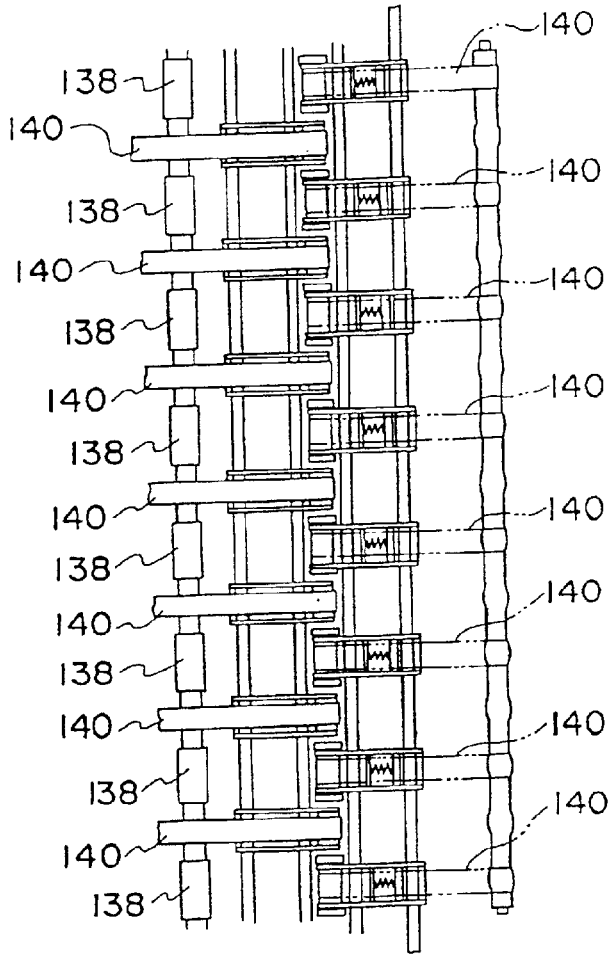
FIGS. 4A, 4B, and 4C are plan views which each show a portion of a conveying system of the plate supplying section.
Figure 4B:
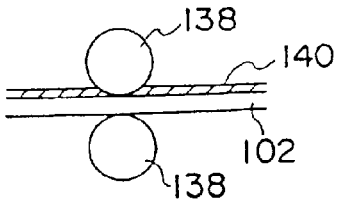
Figure 4C:
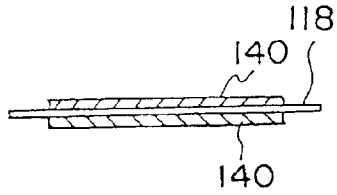

As shown in FIG. 1 and FIG. 4A, in each of the shared conveying portion 128 and the conveying switch portion 136, a conveying system in which skewered rollers 138 and narrow belts 140 are combined together, is used and the photopolymer plate 102 is mainly conveyed by the conveying system (see FIG. 4B). That is, the photopolymer plate 102 is conveyed by a strong holding force of the skewered rollers 138, and the narrow belts 140 each serve as a guide plate which moves synchronously with the conveying of the photopolymer plate 102. On the other hand, as shown in FIG. 1 and FIG. 4C, the interleaf paper conveying portion 134 is a conveying system comprised of only the narrow belts 140, in which the interleaf paper 118 is conveyed by a weak holding force of the narrow belts 140.

Figure 5:
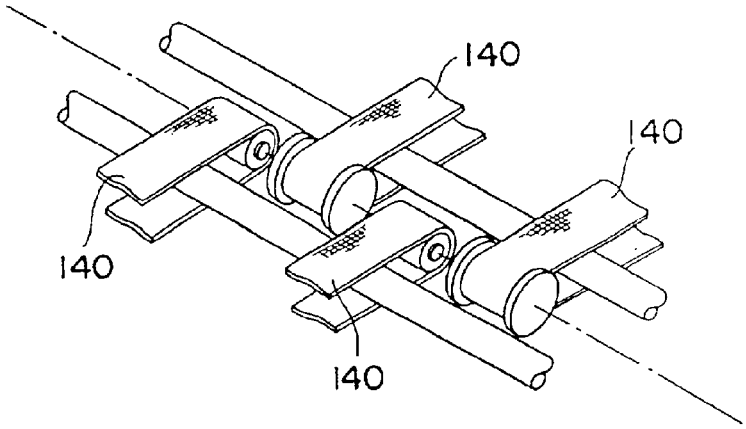
FIG. 5 is a perspective view which shows a transfer portion of a different conveying system of the plate supplying section.

Further, as shown in FIG. 5, in a transfer portion of each conveying portion, respective head (turn-back) portions of the belts 140 are alternately protruded in a skewered manner so that a concave region between adjacent belts 140 on one side faces a protruding head portion of the belt 140 on another side and a protruding head portion of the belt 140 on the one side faces a concave region between adjacent belts 140 on the another side (that is, a common coaxial conveying path is provided). Accordingly, there is prevented a drawback in that when the photopolymer plate 102 and the interleaf paper 118 are each transferred between the conveying portions, the photopolymer plate 102 and the interleaf paper 118 are wound in the skewered rollers 138 or in the narrow belts 140.

Interleaf Paper Conveying Portion 134:

As shown in FIG. 3, the interleaf paper accommodating portion 132 is provided in the carriage 200 and the interleaf papers 118 conveyed by the interleaf paper conveying portion 134, which will be described later, are accommodated in the interleaf paper accommodating portion 132. Further, a sheet material forced accumulation device 141 is provided at an upper end of the interleaf paper accommodating portion 132 in the carriage 200 so as to forcedly accumulate, in the interleaf paper accommodating portion 132, the interleaf papers 118 conveyed by the interleaf paper conveying portion 134.

Figure 6:
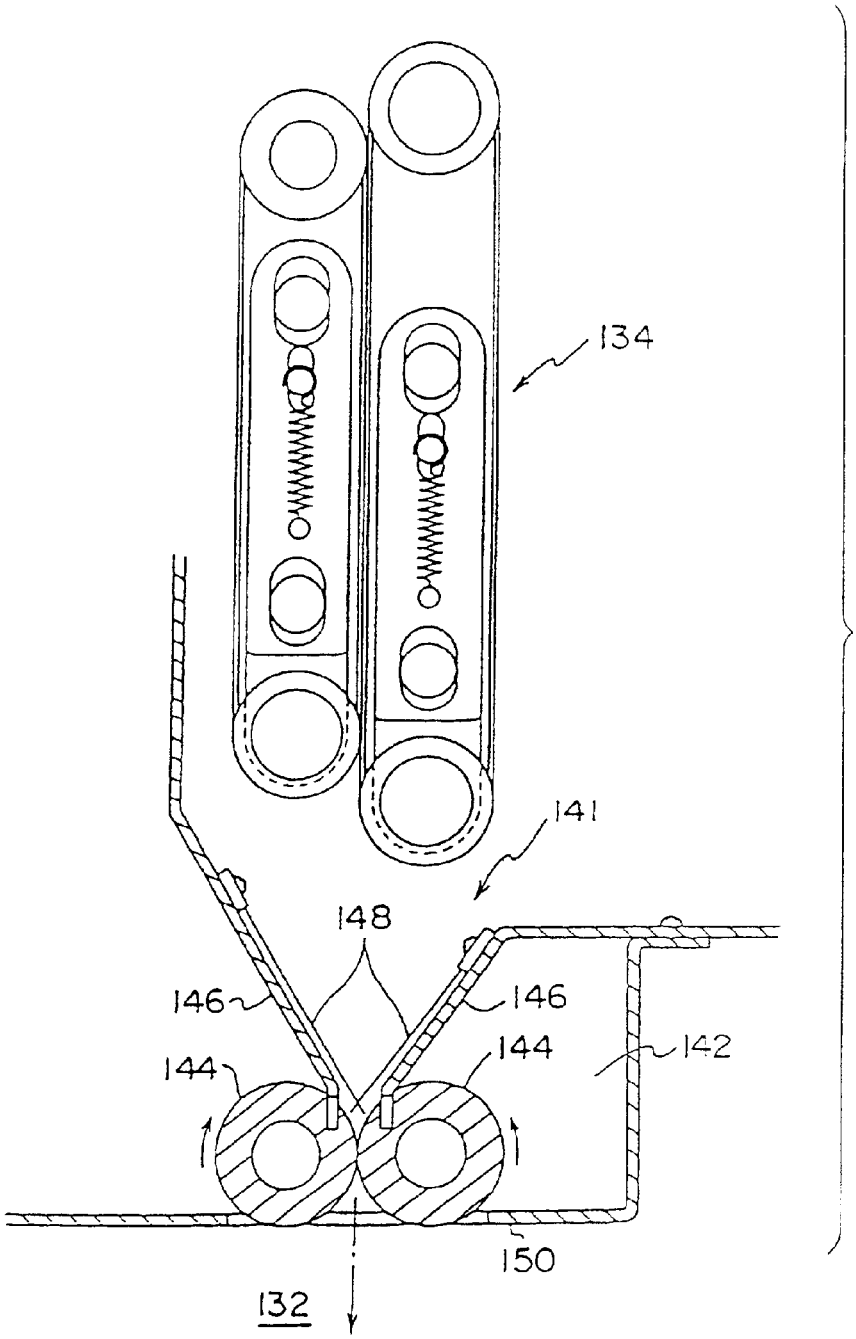
FIG. 6 is a cross sectional view which shows details of a forced accumulation device of sheet materials.
Figure 7:
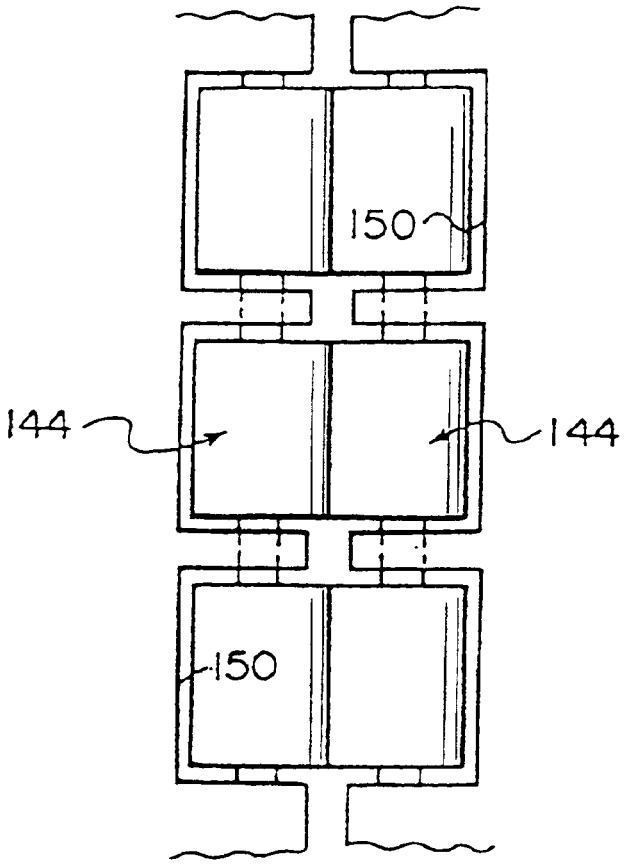
FIG. 7 is a plan view which shows rollers and a roll-in preventing plate of the forced accumulation device of sheet materials.

FIG. 6 shows a detailed structure of the sheet material forced accumulation device 141. As shown in this figure, in the sheet material forced accumulation device 141, a pair of rollers 144 serving as nipping and feeding rollers are provided at an insertion opening 142 of the interleaf paper 118 provided at an upper end of the interleaf paper accommodating portion 132. As shown in FIG. 7, the pair of rollers 144 are skewered rollers and are driven to rotate at a linear velocity which is a little higher (about 1.1 times) than a conveying speed set in the interleaf paper conveying portion 134. As a result, when the interleaf paper 118 is suspended between the interleaf paper conveying portion 134 and the rollers 144, the interleaf paper 118 is conveyed while a predetermined tension state is maintained (that is, in a freely stretched manner), jamming of the interleaf paper 118 caused by slackness formed therein, or the like can be prevented.

Returning now to FIG. 6, a tapered guide plate 146 of which widthwise dimension (in the direction of thickness of the interleaf paper 118) gradually decreases, is provided at the front side of the insertion opening 142. Further, the tapered guide plates 146 facing each other are each provided with a charge removing brush 148 so as to remove charge from the interleaf paper 118 to be inserted in the insertion opening 142.

A wind-in preventing plate 150 is provided in a vicinity of a lower portion of the pair of rollers 144 along irregularities formed by the skewered shape of the rollers 144. Accordingly, even if the interleaf paper 118 having passed through the rollers 144 and accumulated in the interleaf paper accommodating portion 132 partially contacts the rollers 144, wind-in of the interleaf paper 118 can be prevented by the wind-in preventing plate 150.

Exposure-Conveying Section 110:

As shown in FIG. 1, the exposure-conveying section 110 includes the surface table 402. The photopolymer plate 102 conveyed by the photopolymer plate conveying portion 130 and separated therefrom in a state of being horizontally conveyed, is transferred to the surface table 402 and placed on the upper surface thereof.

Figure 8A:
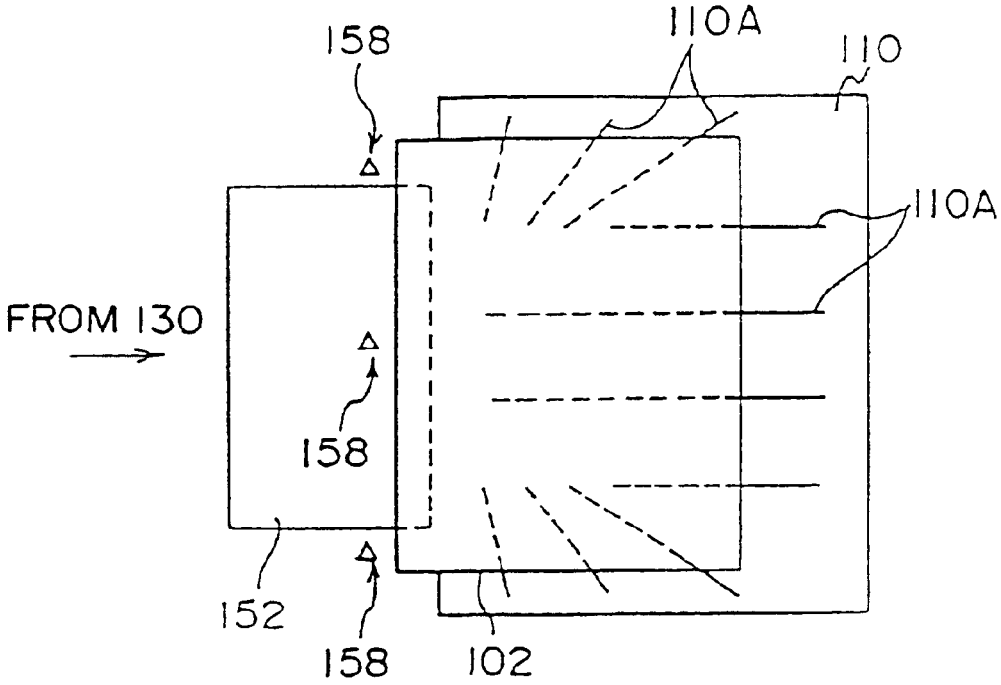
FIG. 8A is a plan view of a surface table.
Figure 8B:
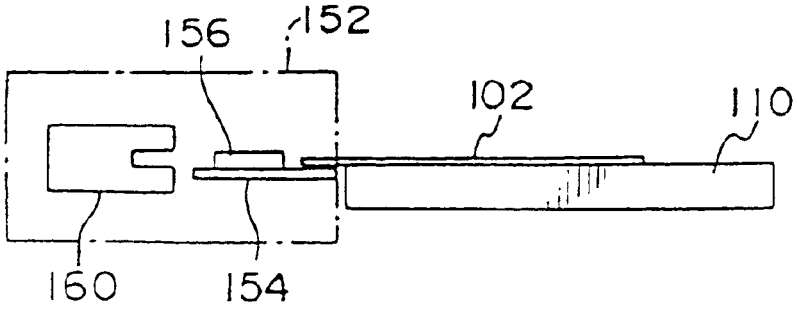
FIG. 8B is a side view of the surface table.

The upper surface of the surface table 402 is disposed at a position lower than a position at which the photopolymer plate 102 is horizontally conveyed by the photopolymer plate conveying portion 130, and there is a space or gap between the surface table 402 and the photopolymer plate conveying portion 130 in the direction in which the photopolymer plate 102 is conveyed. For this reason, the photopolymer plate 102 discharged from the photopolymer plate conveying portion 130 arrives on the surface table 402 in such a manner that the leading end thereof slightly hangs, and the trailing end of the photopolymer plate 102 in the conveying direction is positioned further at the upstream side of the surface table 402 in the conveying direction of the plate 102. As shown in FIG. 8, a temporary supporting arm 154 provided in the discharging mechanism portion 166, which will be described later, is disposed at the upstream side of the surface table 402 so as to prevent hanging of the photopolymer plate 102.

A movable body 152 is provided in the vicinity of the temporary supporting arm 154 so as to be capable of moving close to and apart from the surface table 402. Further, the movable body 152 includes a pressing plate 156 which pushes the trailing end of the photopolymer plate 102 in the conveying direction. When the pressing plate 156 pushes the trailing end of the photopolymer plate 102, a diagonal feed of the photopolymer plate 102 is cancelled, and the photopolymer plate 102 can be conveyed to a predetermined reference position in the conveying direction. The reference position is a position at which the trailing end of the photopolymer plate 102 in the conveying direction protrudes from the surface table 402 by a small amount.

At the reference position, sensors 158 are provided at plural positions including two corners at the trailing end of the photopolymer plate 102 in the conveying direction. Due to the trailing end of the photopolymer plate 102 being detected by these sensors 158, pushing by the pressing plate 156 is stopped. Further, these sensors 158 are also used to detect positions on the photopolymer plate 102 along the transverse direction perpendicular to the conveying direction. That is, the corners of the photopolymer plate 102 and the sensors 158 are caused to coincide with each other by the surface table 402 moving in the transverse direction of the photopolymer plate 102 perpendicular to the conveying direction, and the position at which the corners of the photopolymer plate 102 and the sensors coincide with each other is registered as an initial position of the photopolymer plate 102.

The position of the photopolymer plate 102 moved to the initial position is set so as to become a relative position for a scanning-exposure starting position in the exposure section 112, which will be described later. In this state, the photopolymer plate 102 is adhered by suction to and held by a suction groove 110A provided in the surface table 402. A puncher 160 provided in the movable body 152 punches holes in the photopolymer plate 102 adhered by suction and held by the surface table 402.

Figure 10:
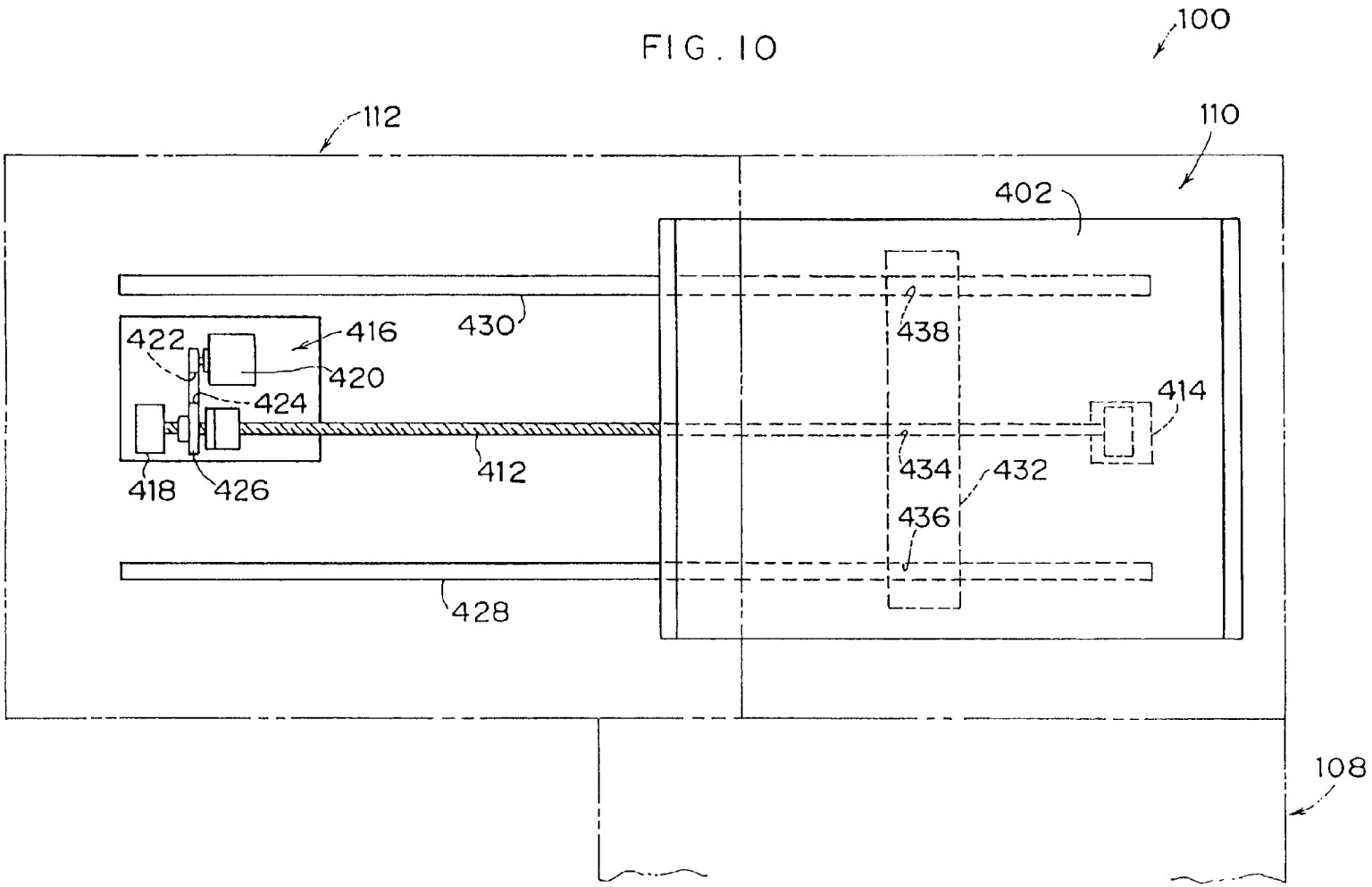
FIG. 10 is a plan view which shows a structure of a driving mechanism of a surface table in an exposure-conveying section.

A ball screw 412 which forms a driving device is disposed below the surface table 402. As shown in FIG. 10, the ball screw 412 is disposed in such a manner that the longitudinal direction (axial direction) thereof extends from an initial position of the photopolymer plate 102 (that is, a position at which the photopolymer plate 102 separated from the photopolymer plate conveying portion 130 is transferred) to the exposure section 112, which will be described later. A supporting stand 414 is disposed at one of longitudinal direction ends of the ball screw 412 and supports the one longitudinal direction end of the ball screw 412 rotatably therearound. On the other hand, an actuator 416 which forms, together with the ball screw 412, the driving device is disposed at another longitudinal direction end of the ball screw 412. The another longitudinal direction end of the ball screw 412 is rotatably supported by a supporting stand 418 provided in the actuator 416, around the another longitudinal direction end of the ball screw 412.

The actuator 416 includes a motor 420. An output axis of the motor 420 is disposed so that an axial direction thereof is made parallel to the ball screw 412, and an external gear 422 is formed at an end of the output axis. Further, a gear 424 is formed in the vicinity of another longitudinal direction end of the ball screw 412 coaxially therewith, and the gear 422 and the gear 424 are connected by a toothed belt 426. As a result, driving force of the motor 420 is transmitted to the ball screw 412.

A guide bar 428 is disposed at the side of the ball screw 412, and a guide bar 430 is disposed at the side of the ball screw 412 opposite to the side at which the guide bar 428 is disposed. The guide bars 428 and 430 are disposed parallel to the ball screw 412.

A slider 432 is fixed integrally to a lower side of the surface table 402. The slider 432 is formed into a block-shaped member as a whole. A screw hole 434 is formed in the slider 432 so as to pass therethrough along the axial direction of the ball screw 412, and the ball screw 412 is screwed with the screw hole 434 in a state of passing therethrough. Through holes 436 and 438 are formed at both sides of the screw hole 434 respectively. An inner diameter of the through hole 436 is made slightly larger than an outer diameter of the guide bar 428, and the guide bar 428 passes through the through hole 436. Further, an inner diameter of the through hole 438 is made slightly larger than an outer diameter of the guide bar 430, and the guide bar 430 passes through the through hole 438. Due to the guide bars 428 and 430 passing through the, through holes 436 and 438 respectively, displacement of the slider 432 in other directions than the longitudinal direction of the guide bars 428 and 430 is restricted by the guide bars 428 and 430.

Exposure Section 112:

As shown in FIG. 1, in the exposure section 112, a scanning unit 164 is provided at a position above the conveying path on the surface table 402. Main scanning (in a direction perpendicular to the moving direction of the surface table 402) is carried out using laser beams which are controlled so as to be switched in accordance with an image signal. Forward movement of the surface table 402 is sub-scan movement. As a result, during the forward movement of the surface table 402 to the exposure section 112, an image is recorded on the photopolymer plate 102 held on the surface table 402, and the photopolymer plate 102 is moved back to an original position by backward movement of the surface table 402. After the photopolymer plate 102 placed on the surface table 402 has been moved back to the original position, vacuum application is terminated thereby releasing the photopolymer plate 102.

Discharging Mechanism Section 166:

In correspondence to the surface table 402 on which the photopolymer plate 102 with an image being recorded is moved back to the original position, the discharging mechanism section 166 is provided at the side of the trailing end of the photopolymer plate 102, in the conveying direction of the plate 102 by the photopolymer plate conveying portion 130 (at a position close to the movable body 152).

As shown in FIG. 9, in the discharge mechanism section 166, the above-described one pair of temporary supporting arms 154 are swingably supported by a stage base 168 via a supporting shaft 170, and ends of the temporary supporting arms 154 are positioned in the vicinity of the surface table 402. A convex portion 172, a concave portion 174, and a convex portion 176 having different dimensions (heightwise or depthwise dimensions) are formed on a lower surface of the temporary supporting arm 154.

A moving stage 178 is disposed below the temporary supporting arm 154. The moving stage 178 can move along the temporary supporting arm 154. A roller 180 is provided at an end of the moving stage 178 and abuts against the lower surface of the temporary supporting arm 154. Accordingly, due to movement of the moving stage 178, a position at which the roller 180 abuts against and is supported by the temporary supporting arm 154 (that is, the convex portion 172, the concave portion 174, and the convex portion 176) is changed, and the upper position of the end of the temporary supporting arm 154 is thereby changed. Further, a spring 182 is connected at a basal end of the temporary supporting arm 154, and the temporary supporting arm 154 is adapted to constantly follow the movement of the moving stage 178.

Figure 9A:
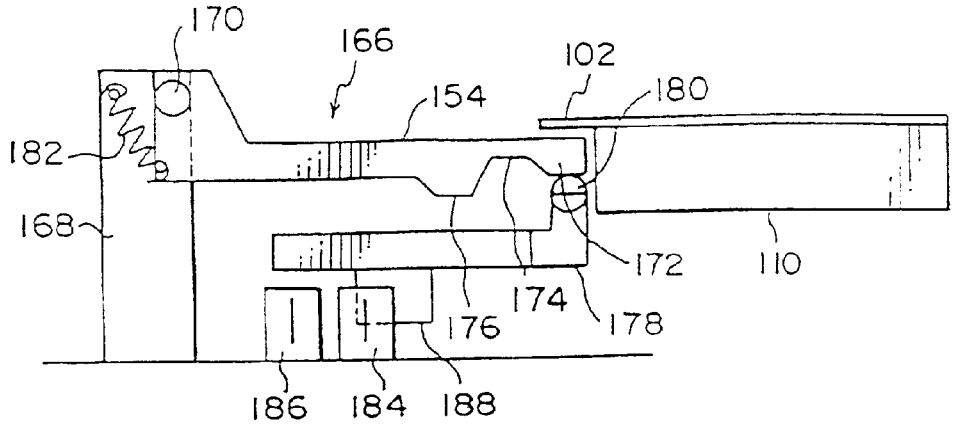
FIGS. 9A to 9C are side views which each show an operation of a discharging mechanism section.
Figure 9B:
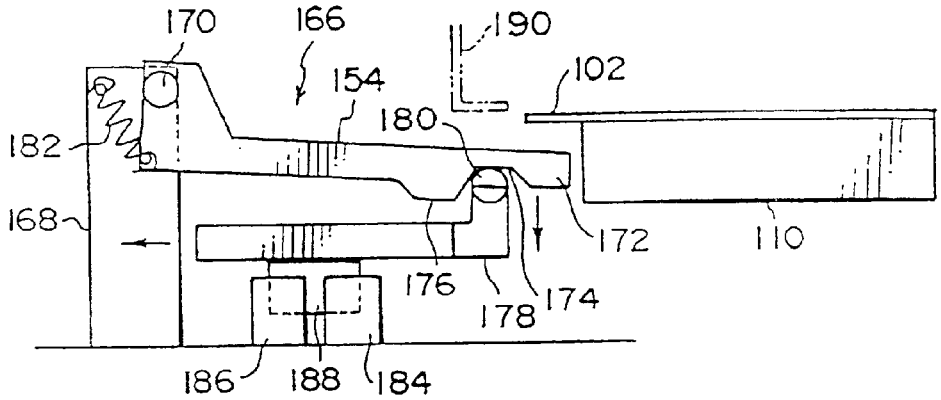
Figure 9C:
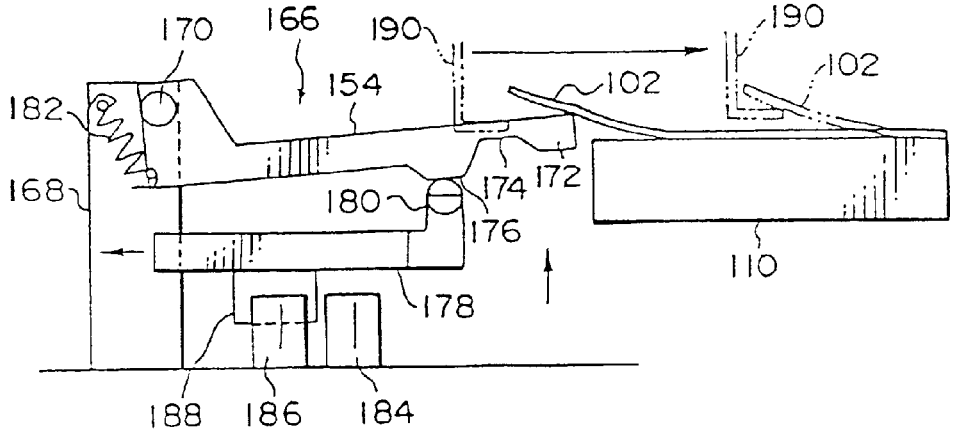

The respective dimensions of the convex portion 172, the concave portion 174, and the convex portion 176 are set such that: in a state in which the roller 180 abuts against and is supported by the convex portion 172, the temporary supporting arm 154 is, as shown in FIG. 9A, placed at the same horizontal position as the surface table 402; in a state in which the roller 180 abuts against and is supported by the concave portion 174, the temporary supporting arm 154 is, as shown in FIG. 9B, placed at a position lower than the surface table 402, that is, at a retracted position; and in a state in which the roller 180 abuts against and is supported by the convex portion 176, the temporary supporting portion 154 is, as shown in FIG. 9C, placed at a position higher than the surface table 402, that is, at a pushed-up position. Accordingly, when the roller 180 of the moving stage 178 abuts against the convex portion 172 of the temporary supporting arm 154 and the temporary supporting arm 154 is placed at the same horizontal position as the surface table 402, hanging of the photopolymer plate 102 on the surface table 402 can be prevented. Further, when the roller 180 of the moving stage 178 abuts against the convex portion 176 of the temporary supporting arm 154 and the temporary supporting arm 154 is pushed up and placed at a position higher than the surface table 402, a trailing end of the photopolymer plate 102 placed on the surface table 402 can be lifted up.

A pair of sensors 184 and 186 are disposed below the moving stage 178. These sensors 184 and 186 each detect a dog 188 provided in the moving stage 178 so as to detect the position of the moving stage 178, that is, the position of the temporary supporting arm 154. In a state in which the dog 188 is detected by only the sensor 184, the temporary supporting arm 154 is placed at the same horizontal position as the surface table 402. In a state in which the dog 188 is detected by both of the sensors 184 and 186, the temporary supporting arm 154 is placed at the retracted position lower than the surface table 402. In a state in which the dog 188 is detected by only the sensor 186, the temporary supporting arm 154 is pushed up and placed at a position higher than the surface table 402.

Further, in the discharging mechanism section 166, a pair of plate discharging claws 190 are provided above the temporary supporting arms 154. As shown in FIGS. 9B and 9C, the pair of plate discharging claws 190 can be moved along a guide rail (not shown) disposed along the surface table 402. That is, the plate discharging claws 190 passes above the surface table 402 and moves to the leading end of the photopolymer plate 102 in the conveying direction.

In a state in which the trailing end of the photopolymer plate 102 protruded from the surface table 402 is lifted up by the temporary supporting arms 154 as described above, the plate discharging claws 190 move in the direction in which the photopolymer plate 102 is conveyed to thereby catch the photopolymer plate 102. Accordingly, the photopolymer plate 102 caught by the plate discharging claws 190 is adapted to be conveyed to a downstream side of the surface table 402 accompanied with the movement of the plate discharging claws 190.

As described above, as shown in FIG. 1, when supply of plates, exposure, and development are all automatically processed in such a manner that the automatic developing apparatus 116 is connected via a buffer section 114 at a downstream side of the above-described surface table 402, the photopolymer plate 102 is smoothly conveyed while eliminating, by the buffer section 114, the difference between the discharging speed in the discharging mechanism section 166 and the conveying speed in the automatic developing apparatus 116.

[Structure of Discriminating Device 510]

Figure 12:
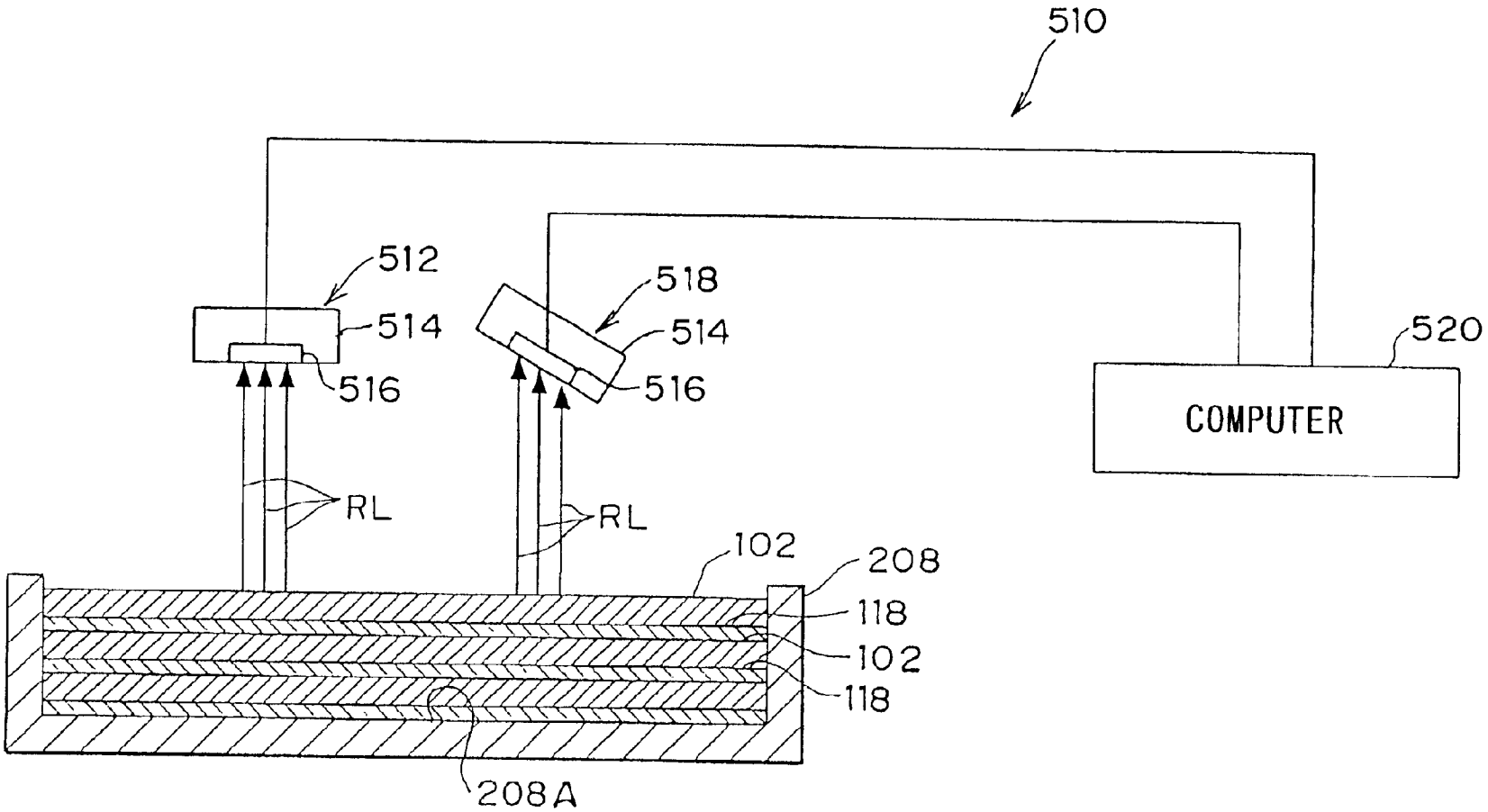
FIG. 12 is a diagram which schematically shows a structure of a discriminating device according to the present invention.

Next, a description will be given of the structure of the discriminating device 510 according to the embodiment of the present invention. As shown in FIG. 11, the discriminating device 510 includes an optical sensor 512 serving as a first optical sensor which is provided on an upper wall of the housing 302 forming the sucker unit 300. As shown in FIG. 12, the optical sensor 512 is formed by a case 514 and a light receiving portion 516 provided in the case 514. When the light receiving portion 516 receives light having a predetermined intensity, an electric signal is generated (that is, the optical sensor 512 is brought into a reactive state). The optical sensor 512 is set so that the light receiving portion 516 faces an optical axis of reflected light RL emitted from a light source (not shown) and reflected by the surface of the photopolymer plate 102 or the interleaf paper 118 located at an uppermost position in the stack, and even if the reflected light from the photopolymer plate 102 or the interleaf paper 118 is received, an electric signal is generated. However, an electric signal is not generated by reflected light RL from a bottom wall 208A of the magazine 208 (that is, the optical sensor 512 is brought into a nonreactive state). In other words, the bottom wall 208A of the magazine 208 has a surface reflectivity lower than those of the photopolymer plate 102 and the interleaf paper 118. For this reason, the light receiving portion 516 cannot detect the reflected light RL from the bottom wall 208A of the magazine 208. The surface reflectivity of the bottom wall 208A needs to be made lower than those of the photopolymer plate 102 and the interleaf paper 188. Accordingly, when the surface reflectivity of the bottom wall 208A is equal to or higher than those of the photopolymer plate 102 and the interleaf paper 188, a coating material of color such as black or brown, by which light is not reflected or is difficult to be reflected, is applied to the bottom wall 208A so that the surface reflectivity of the bottom wall 208A can be lowered intentionally.

Further, as shown in FIG. 11, an optical sensor 518 serving as a second optical sensor is disposed at the side of the optical sensor 512 in the longitudinal direction of the movable frame 304. As shown in FIG. 12, the optical sensor 518 has the same structure as that of the optical sensor 512 in that it is formed by the case 512 and the light receiving portion 516 provided in the case 512. Further, operationally, when the light receiving portion 516 of the optical sensor 518 receives light of which intensity is greater than or equal to the intensity of light received by the light receiving portion 516 of the optical sensor 512, an electric signal is generated (that is, the optical sensor 518 is brought into a reactive state). However, as shown in FIG. 12, the light receiving portion 516 of the optical sensor 518 is disposed so as to be inclined by a predetermined angle to an optical axis of the reflected light RL, and therefore, an amount of light received by the light receiving portion 516 of the optical sensor 518 per unit area decreases. As a result, the level at which reflected light is detected by the optical sensor 518 substantially becomes lower as compared with the optical sensor 512. Accordingly, for example, when reflected light at a lower limit level at which receiving of light can be detected is received by each light receiving portion 516, an electric signal is generated by the optical sensor 512, but no electric signal is generated by the optical sensor 518.

The detection level of the optical sensor 518 in a state of being installed in the housing 302 is adapted so as to detect that reflected light from the photopolymer plate 102 is received, and so as not to detect reflected light from the interleaf paper 118 of which surface reflectivity is lower than that of the photopolymer plate 102. In order to correspond to the above-described detection level of the optical sensor 518, the angle of inclination of the optical sensor 518 is set.

Further, as shown in FIG. 12, the respective light receiving portions 516 of the optical sensors 512 and 518 are electrically connected to a computer 520 serving as the discriminating device, and an electric signal from each of the light receiving portions 516 is transferred to the computer 520.

In the computer 520, based on the electric signal from each of the light receiving portions 516, it is determined whether the uppermost layer of the photopolymer plates 102 and the interleaf papers 118 stacked in the magazine 208 is the photopolymer plate 102 or the interleaf paper 118, or whether nothing is placed in the magazine 208. Based on the result of this determination, a suction fan of the sheet feeding section 106, or the conveying switch portion 136 is controlled.

[Operation and Effects of the Present Embodiment]

Next, operation and effects of the present embodiment will be described.

First, overall operation of the automatic exposure apparatus 100 will be briefly described.

The photopolymer plates 102 and the interleaf papers 118 accommodated in the magazine 208 are alternately taken out by a suction conveying device 109 (that is, the suction unit 304), and conveyed to the shared conveying portion 128. The photopolymer plate 102 conveyed to the shared conveying portion 128 is further conveyed by the photopolymer plate conveying portion 130 and placed and positioned on the surface table 402 of the exposure-conveying section 110. After positioning of the photopolymer plate 102, which will be described later, is completed, the surface table 402 moves to slide from a first position at which the photopolymer plate 102 is received (the position indicated by the solid lines in FIG. 1) to a second position at which the photopolymer plate 102 is accommodated in the exposure section 112 (the position indicated by the phantom lines in FIG. 1). As a result, the photopolymer plate 102 is accommodated in the exposure section 112 and an image is exposed in the exposure section 112. After exposure processing for the photopolymer plate 102 in the exposure section 112 is completed, the surface table 402 moves to slide from the second position to the first position. When the surface table 402 moves back to the first position, the photopolymer plate 102 is discharged from the discharging mechanism section 166. On the other hand, the interleaf paper 118 is conveyed by the shared conveying portion 128 and the interleaf paper conveying portion 134, and accumulated in the interleaf paper accommodating portion 132 by the sheet material forced accumulation device 141 provided in the carriage 200.

Next, operation and effects of the exposure-conveying section 110 according to the present embodiment will be described.

Next, operation and effects of the discriminating device 510 will be described.

The discriminating device 510 operates at a stage before the photopolymer plate 102 or the interleaf paper 118 is suction adhered to the suckers 124, that is, before the motor 316 is actuated.

First, the discriminating device 510 causes light from a light source (not shown) to be emitted to the photopolymer plates 102 and the interleaf papers 118 stacked in the magazine 208. The emitted light is reflected by the surface of the uppermost layer of the photopolymer plates 102 and the interleaf papers 118 in the stack and made into reflected light RL. The reflected light RL is received by the respective light receiving portions 516 of the optical sensors 512 and 518.

When the photopolymer plate 102 is located at the uppermost position and the reflected light RL by the photopolymer plate 102 is received by the light receiving portion 516 of the optical sensor 512, the light receiving portion 516 of the optical sensor 512 generates an electric signal (that is, the optical sensor 512 is brought into a reactive state). Further, when the reflected light RL by the photopolymer plate 102 is received by the light receiving portion 516 of the optical sensor 518, the light receiving portion 516 of the optical sensor 518 also generates an electric signal (that is, the optical sensor 518 is brought into a reactive state). When the computer 520 receives signals from the light receiving portions 516 of the optical sensors 512 and 518 (that is, when it is recognized by the computer 520 that the optical sensors 512 and 518 are both placed in the reactive state), it is determined that the photopolymer plate 102 is located at the uppermost position, and the motor 316 is rotated until the suckers 124 arrives at a position at which the photopolymer plate 102 can be suction adhered to the suckers 124. Further, the conveying switch portion 136 is controlled so that the photopolymer plate 102 conveyed to the shared conveying portion 128 is further conveyed to the photopolymer plate conveying portion 130.

The surface reflectivity of the interleaf paper 118 is lower than that of the photopolymer plate 102, and therefore, when the interleaf paper 118 is located at the uppermost position, the intensity of the reflected light RL by the interleaf paper 118 is lower than that of the reflected light RL by the photopolymer plate 102. Even if the light receiving portion 516 of the optical sensor 512 receives the reflected light RL by the interleaf paper 118, it generates an electric signal. On the other hand, the light receiving portion 516 of the optical sensor 518 is disposed so as to be inclined to the optical axis of the reflected light RL, and therefore, an amount of light received by the light receiving portion 516 of the optical sensor 518 per unit area decreases. As a result, the detection level of the reflected light in the optical sensor 518 substantially becomes low as compared with the optical sensor 512.

For this reason, even if the light receiving portion 516 of the optical sensor 518 receives the reflected light RL by the interleaf paper 118 of which intensity is lower than the reflected light RL by the photopolymer plate 102, the optical sensor 518 does not detect that the light receiving portion 516 has received the reflected light RL. As a result, no electric signal is generated from the light receiving portion 516 of the optical sensor 518 (that is, the optical sensor 518 remains in a nonreactive state). The computer 520 receives a signal from the light receiving portion 516 of the optical sensor 512, but does not receive a signal from the light receiving portion 516 of the optical sensor 518 (that is, it is recognized by the computer 520 that the optical sensor 512 is in a reactive state and the optical sensor 518 is in a nonreactive state). As a result, it is determined that the interleaf paper 118 is located at the uppermost position. A blower is operated so as to lift up the interleaf paper 118, and the motor 316 is rotated until the suckers 124 arrives at a position at which the interleaf paper 118 can be suction adhered to the suckers 124. Further, the conveying switch portion 136 is controlled so that the interleaf paper 118 conveyed to the shared conveying portion 128, is further conveyed to the interleaf paper conveying portion 134.

Further, when neither the photopolymer plate 102 nor the interleaf paper 118 is placed in the magazine 208, light is reflected by the bottom wall 208A of the magazine 208. The surface reflectivity of the bottom wall 208A is lower than those of the photopolymer plate 102 and the interleaf paper 118. Accordingly, even if the light receiving portion 516 of the optical sensor 512 receives the reflected light RL by the bottom wall 208A of the magazine 208, the light receiving portion 516 of the optical sensor 512 does not detect the reflected light RL. Naturally, the light receiving portion 516 of the optical sensor 518 whose detection level is substantially low, also does not detect the reflected light RL, and therefore, no electric signal is generated from both of the light receiving portions 516 of the optical sensors 512 and 518 (that is, the optical sensors 512 and 518 are both in a nonreactive state).

In the computer 520, due to no signal from both of the light receiving portions 516 of the optical sensors 512 and 518 being received (that is, the computer 520 recognizes that the optical sensors 512 and 518 are both in a nonreactive state), it is determined that neither the photopolymer plate 102 nor the interleaf paper 118 is placed in the magazine 208. A notice of this determination is given to an operator, for example, by lighting a lamp of a control panel.

As described above, in the discriminating device 510, it can be determined by the pair of optical sensors 512 and 518 whether the uppermost layer of the stack is the photopolymer plate 102 or the interleaf paper 118, or whether nothing is placed in the magazine 208. In this case, it suffices that the light receiving portions 516 of the optical sensors 512 and 518 in the discriminating device 510 each detect as to whether light of which intensity is a predetermined value or more has been received (that is, it is not necessary for the light receiving portions 516 to identify intensities of three or more kinds of light). Therefore, low-cost general purpose optical sensors can be applied to the optical sensors 512 and 518 of the discriminating device 510. Accordingly, the discriminating device 510 can be manufactured at a low cost and the manufacturing cost of the automatic exposure apparatus 100 can be reduced. Further, the optical sensors 512 and 518 basically have the same structure, and therefore, the manufacturing cost thereof can also be reduced by reason that the number of kinds of parts to be used can be decreased.

What is claimed is:

1. A discriminating device for discriminating between two kinds of objects of determination, which have different surface reflectivities, said device comprising:

a first optical sensor having a light receiving portion which receives light reflected by surfaces of the objects of determination, said first optical sensor reacting to reflected light from both two kinds of objects of determination individually; and a second optical sensor having a light receiving portion which receives the reflected light, said second optical sensor being provided so as to react to reflected light from one of the objects of determination, of which surface reflectivity is higher, and so as not to react to reflected light from the other object of determination of which surface reflectivity is lower;

wherein the reflected light incident upon the light receiving portion of the first optical sensor is substantially perpendicular to a surface of the light receiving portion of the first optical sensor that receives the reflected light, and the reflected light incident upon the light receiving portion of the second optical sensor is oblique to a surface of the light receiving portion of the second optical sensor that receives the reflected light.

2. A discriminating device according to claim 1, wherein the light receiving portion of said first optical sensor is made to face an optical axis of the reflected light, and the light receiving portion of said second optical sensor is inclined to the optical axis of the reflected light.

3. A discriminating device according to claim 1, wherein said first optical sensor and said second optical sensor do not each react to reflected light from a portion in which the two kinds of objects of determination are placed.

4. A discriminating device according to claim 1, wherein a printing plate on which an image is recorded, is used as one of the two kinds of objects of determination, and an interleaf paper of which surface reflectivity is different from that of the printing plate and which is interposed between stacked printing plates, is used as the other one of the two kinds of objects of determination.

5. A discriminating device according to claim 2, wherein said first optical sensor and said second optical sensor do not each react to reflected light from a portion in which the two kinds of objects of determination are placed.

6. A discriminating device according to claim 2, wherein optical sensors of the same specifications are used for said first optical sensor and said second optical sensor.

7. A discriminating device according to claim 3, wherein a printing plate on which an image is recorded, is used as one of the two kinds of objects of determination, and an interleaf paper of which surface reflectivity is different from that of the printing plate and which is interposed between stacked printing plates, is used as the other one of the two kinds of objects of determination.

8. A discriminating device according to claim 5, wherein a printing plate on which an image is recorded, is used as one of the two kinds of objects of determination, and an interleaf paper of which surface reflectivity is different from that of the printing plate and which is interposed between stacked printing plates, is used as the other one of the two kinds of objects of determination.

9. A discriminating device for discriminating between sheets of different kinds of materials, wherein different kinds of materials have different surface reflectivities, the device comprising:

(a) a support for supporting a sheet of material;

(b) an optical sensing arrangement disposed in relation to the support for receiving light reflected from the sheet of material, the optical sensing arrangement having at least one sensor, which when operated, produces an electronic output when the reflected light received from the sheet at least equals a predetermined value, and does not produce output when the reflected light received from the sheet is less than the predetermined value; and (c) a computer connected in electronic communication to the optical sensor and receiving the electronic output from the sensor, the computer including program logic which determines the kind of material in accordance with the electronic output received;

wherein the reflected light incident upon a light receiving portion of a first sensor of the at least one sensor is substantially perpendicular to a surface of the light receiving portion of the first sensor that receives the reflected light, and the reflected light incident upon a light receiving portion of a second sensor of the at least one sensor is oblique to a surface of the light receiving portion of the second sensor that receives the reflected light.

10. A discriminating device according to claim 9, wherein the optical sensing arrangement includes at least two sensors, each sensor when operated, producing an electronic output when reflected light received from the sheet of material reaches a predetermined value for that sensor, with the computer receiving the electronic output from each sensor, the computer program logic determining that the material is of one kind, if electronic output is received from both sensors, and the material is another kind if electronic output is received from one sensor, and not the other sensor.

11. A discriminating device according to claim 10, wherein each sensor is oriented differently, relative to the support.

12. A discriminating device according to claim 10, wherein the computer program logic determines a sheet of material is not present if electronic output is received from neither sensor.

13. A discriminating device according to claim 9, wherein the support comprises a magazine for supporting the sheets of different kinds of materials in a stacked, interleaved arrangement with one another.

14. A discriminating device according to claim 10, wherein the sensors are disposed above the support.

15. A discriminating device according to claim 10, wherein each sensor includes a sensing surface, one of the sensors having its sensing surface facing the support, and the other sensor having its sensing surface inclined relative to the sensing surface of the one sensor.

16. A discriminating device for discriminating between two kinds of objects, wherein each object has a surface with a reflectivity different from the other object and reflects light from the surface along an optical axis, the device comprising:

(a) a first optical sensor having a light receiving portion disposed facing the optical axis, which receives light reflected from the surfaces of the objects, said first optical sensor reacting to reflected light from both two kinds of objects of determination individually; and (b) a second optical sensor having a light receiving portion disposed at an inclination to the optical axis, and provided so as to react to reflected light received from one kind of object, and not to reflected light received from another kind of object;

wherein the reflected light incident upon the light receiving portion of the first optical sensor is substantially perpendicular to a surface of the light receiving portion of the first optical sensor that receives the reflected light, and the reflected light incident upon the light receiving portion of the second optical sensor is oblique to a surface of the light receiving portion of the second optical sensor that receives the reflected light.

17. A discriminating device according to claim 16, wherein the objects are placed in a magazine, and the sensors do not react to light reflected from the magazine.

18. A discriminating device according to claim 16, wherein the objects are placed in a magazine, and one of the kinds of object is a printing plate having an image recording surface, and the other kind of object is an interleaf paper, for interposing between printing plates in a stack of printing plates.

19. A discriminating device according to claim 17, wherein one of the kinds of object is a printing plate having an image recording surface, and the other kind of object is an interleaf paper, for interposing between printing plates in a stack of printing plates placed in the magazine.

20. A discriminating device according to claim 17, wherein each sensor has specifications substantially identical to one another.

21. The discriminating device of claim 1, wherein the first optical sensor reacts to reflected light from both two kinds of objects of determination.

22. The discriminating device of claim 21, wherein the first optical sensor and the second optical sensor have substantially the same specifications.

23. The discriminating device of claim 22, wherein the first optical sensor and the second optical sensor have substantially the same threshold specifications.

* * * * *